US012546334B2

(12) United States Patent
Lee

(10) Patent No.: US 12,546,334 B2
(45) Date of Patent: Feb. 10, 2026

(54) CENTRIFUGAL FAN

(71) Applicant: GRANDVANCE TECHNOLOGY, INC., Taoyuan (TW)

(72) Inventor: Che-Wei Lee, Taoyuan (TW)

(73) Assignee: GRANDVANCE TECHNOLOGY, INC., Taoyuan (TW)

( * ) Notice: Subject to any disclaimer, the term of this patent is extended or adjusted under 35 U.S.C. 154(b) by 0 days.

(21) Appl. No.: 19/185,238

(22) Filed: Apr. 21, 2025

(65) Prior Publication Data

US 2025/0250988 A1 Aug. 7, 2025

Related U.S. Application Data

(63) Continuation-in-part of application No. 18/765,320, filed on Jul. 7, 2024.

(30) Foreign Application Priority Data

Jul. 14, 2023 (TW) ..... 112126424

(51) Int. Cl.
*F04D 29/30* (2006.01)
*F04D 29/28* (2006.01)
*F04D 29/42* (2006.01)

(52) U.S. Cl.
CPC ..... *F04D 29/4226* (2013.01); *F04D 29/281* (2013.01); *F04D 29/30* (2013.01)

(58) Field of Classification Search
None
See application file for complete search history.

(56) References Cited

U.S. PATENT DOCUMENTS

2023/0301017 A1* 9/2023 Chen ..... H05K 7/20154 361/695

FOREIGN PATENT DOCUMENTS

CN 2413073 Y * 1/2001
JP H09126190 A * 5/1997

* cited by examiner

*Primary Examiner* — Courtney D Heinle
*Assistant Examiner* — Danielle M. Christensen
(74) *Attorney, Agent, or Firm* — Cheng-Ju Chiang

(57) ABSTRACT

A centrifugal fan includes a housing, a driving part and an impeller. The housing includes an air inlet, an air outlet, and an internal space. The driving part is secured to the housing, disposed in the internal space, and coaxial with the air inlet. The impeller is disposed in the internal space and coaxially connected to the driving part. The impeller includes a plurality of blades extending radially outward from a ring-shaped member. Each blade of the plurality of blades includes a flow guide. A flow channel space is defined between any two adjacent blades of the plurality of blades. Each flow guide has two side flow guide vanes and at least one dividing flow guide vane. The adjacent two side flow guide vanes and the at least one dividing flow guide vane divide the corresponding flow channel space into at least two flow guide zones.

4 Claims, 11 Drawing Sheets

CENTRIFUGAL FAN

CROSS-REFERENCE TO RELATED APPLICATIONS

This application is a continuation-in-part of U.S. patent application Ser. No. 18/765,320, filed on Jul. 7, 2024, which claims priority of Taiwanese (TW) Patent application Ser. No. 112126424, filed on Jul. 14, 2023, which are herein incorporated by reference.

FIELD OF THE INVENTION

The invention relates to centrifugal fans and more particularly to a centrifugal fan having improved fan efficiency at the same noise level and being easy to manufacture.

BACKGROUND OF THE INVENTION

Referring to FIGS. 12 and 13, a conventional centrifugal fan comprises a housing 81 including an upper housing 811 and a lower housing 812. The upper housing 811 has an air inlet 81A and an air outlet 81B. An internal space 81C is defined by the upper housing 811 and the lower housing 812. The internal space 81C communicates with the air inlet 81A and the air outlet 81B.

The centrifugal fan further comprises a driving part 82 secured to the lower housing 812 and disposed in the internal space 81C. The driving part 82 is coaxial with the air inlet 81A.

The centrifugal fan further comprises an impeller 83 is disposed in the internal space 81C. The impeller 83 is coaxially connected to the driving part 82. The impeller 83 includes a ring-shaped member 831 and a plurality of blades 832. The ring-shaped member 831 is used for the impeller 83 to be coaxially connected to the driving part 82 and can be driven to rotate. The plurality of blades 832 extend radially outward from the ring-shaped member 831. A flow channel space S is defined between any two adjacent ones of the plurality of blades 832.

Thereby, when the impeller 83 rotates, air 91 is sucked to enter the internal space 81C through the air inlet 81A, and the air 91 follows through the plurality of flow channel spaces S between the plurality of blades 32 by centrifugal force. Finally, it flows out of the fan through the air outlet 81B.

However, the conventional centrifugal fan has the following problem: it generates considerable noise during normal operation, especially when the conventional centrifugal fan is installed in a personal computer. For reducing noise, the rotation speed of the fan must be reduced (and the flow rate will also be reduced), resulting in a dilemma.

In view of this, it is necessary to develop technology for solving the problem created by the conventional centrifugal fan.

SUMMARY OF THE INVENTION

The purpose of the invention is to provide a centrifugal fan that has advantages of improved fan efficiency at the same noise level and being easy to manufacturing. In particular, the problem that the invention aims to solve is as follows. The conventional centrifugal fan generates considerable noise during normal operation. For reducing noise, the rotation speed must be reduced (and the flow rate will also be reduced), resulting in a dilemma.

The technical means to solve the above problem is to provide a centrifugal fan comprising:

a housing including a lower housing, an upper housing having an air inlet and an air outlet, and an internal space defined by the upper housing and the lower housing, the internal space communicating with the air inlet and the air outlet;

a driving part secured to the lower housing, disposed in the internal space, and being coaxial with the air inlet; and an impeller disposed in the internal space and coaxially connected to the driving part, the impeller including a ring-shaped member for coaxially connecting the impeller to the driving part, the ring-shaped member being configured to drive for rotation, and a plurality of blades extending radially outward from the ring-shaped member wherein each blade of the plurality of blades include a flow guide, a flow channel space is defined between every two adjacent blades of the plurality of blades, the every two adjacent blades define a first adjacent blade and a second adjacent blade; each flow guide has two side flow guide vanes and at least one dividing flow guide vane, and the adjacent two side flow guide vanes and the at least one dividing flow guide vane are configured to divide the corresponding flow channel space into at least two flow guide zones; and wherein the at least one dividing flow guide vane of the second adjacent blade and the two side flow guide vanes of the first adjacent blade are separated and not connected to each other;

wherein the two side flow guide vanes extend a first length along a first direction from the first adjacent blade; the two side flow guide vanes are substantially perpendicular to the first adjacent blade;

the at least one dividing flow guide vane extends a second length along a second direction from the second adjacent blade, the second direction being opposite to the first direction;

a gap is defined between the first adjacent blade and the second adjacent blade; the first length is larger than one half of the gap and the second length is larger than one half of the gap so as to form an overlapping zone; the at least one dividing flow guide vane is sandwiched between the two side flow guide vanes without contact in the overlapping zone; the two side flow guide vanes and the at least one dividing flow guide vane are parallel to each other, thereby dividing the corresponding flow channel space into the at least two flow guide zones;

wherein said side flow guide vanes, said at least one dividing flow guide vane, and said blades having a same thickness, so that said side flow guide vanes being bendable from said blades and said at least one dividing flow guide vane being bendable from said blades.

The above and other objects, features and advantages of the invention will become apparent from the following detailed description taken with the accompanying drawings.

DETAILED DESCRIPTION OF THE INVENTION

Figure 1:
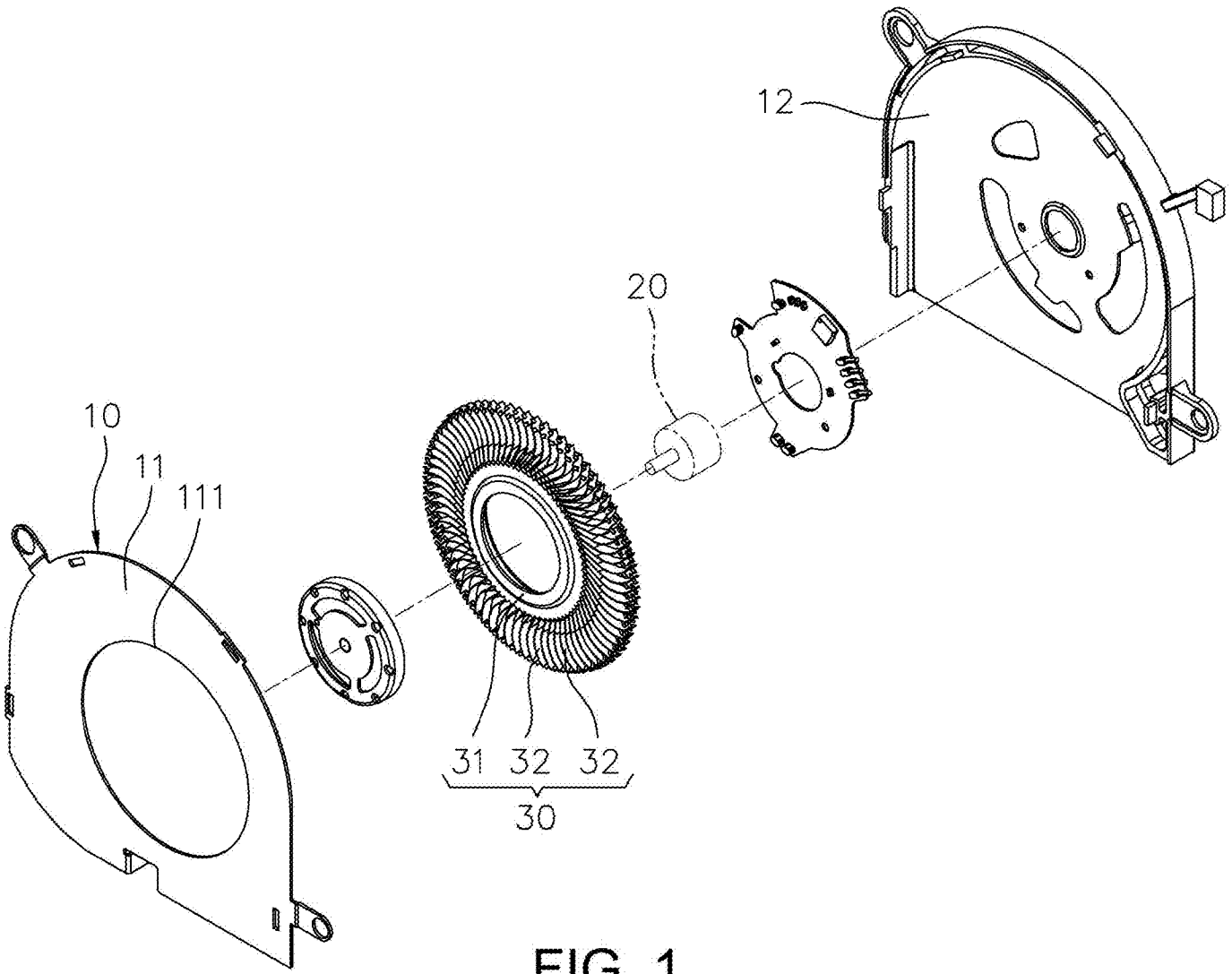
FIG. 1 is an exploded view of a centrifugal fan according to a first preferred embodiment of the invention.
Figure 2:
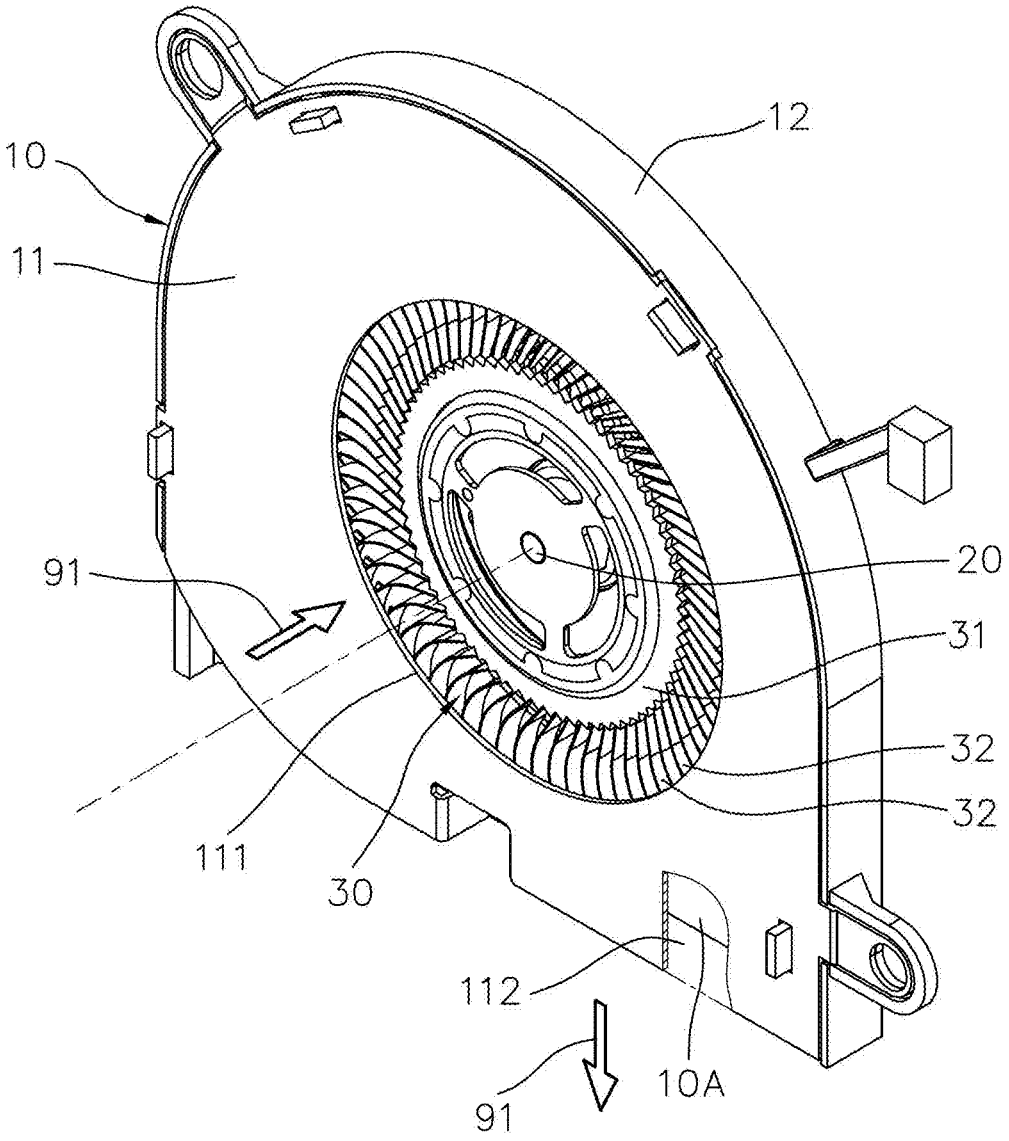
FIG. 2 is a perspective view of the assembled centrifugal fan in FIG. 1.
Figure 3:
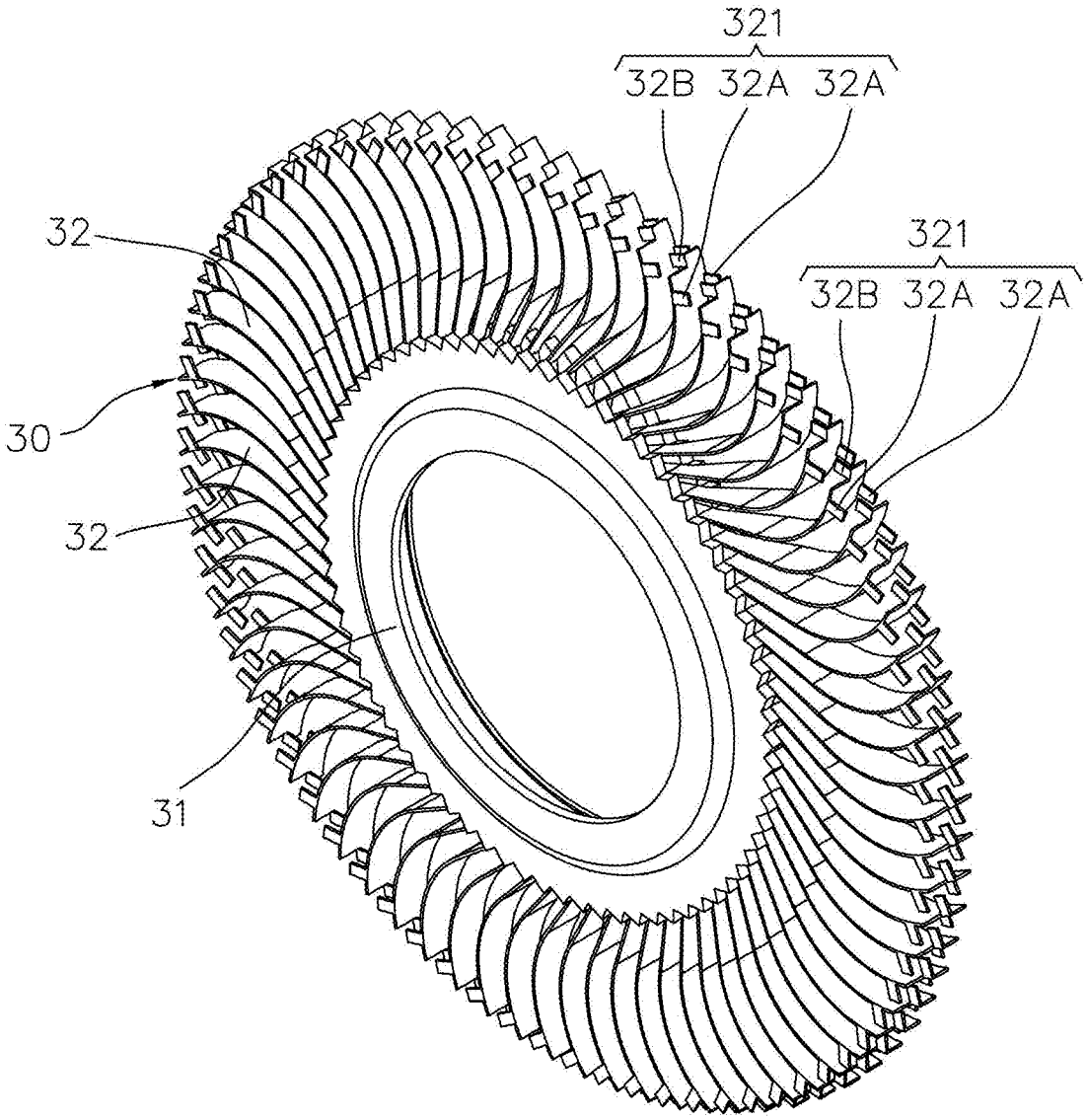
FIG. 3 is an enlarged view of some components in FIG. 1.
Figure 4:
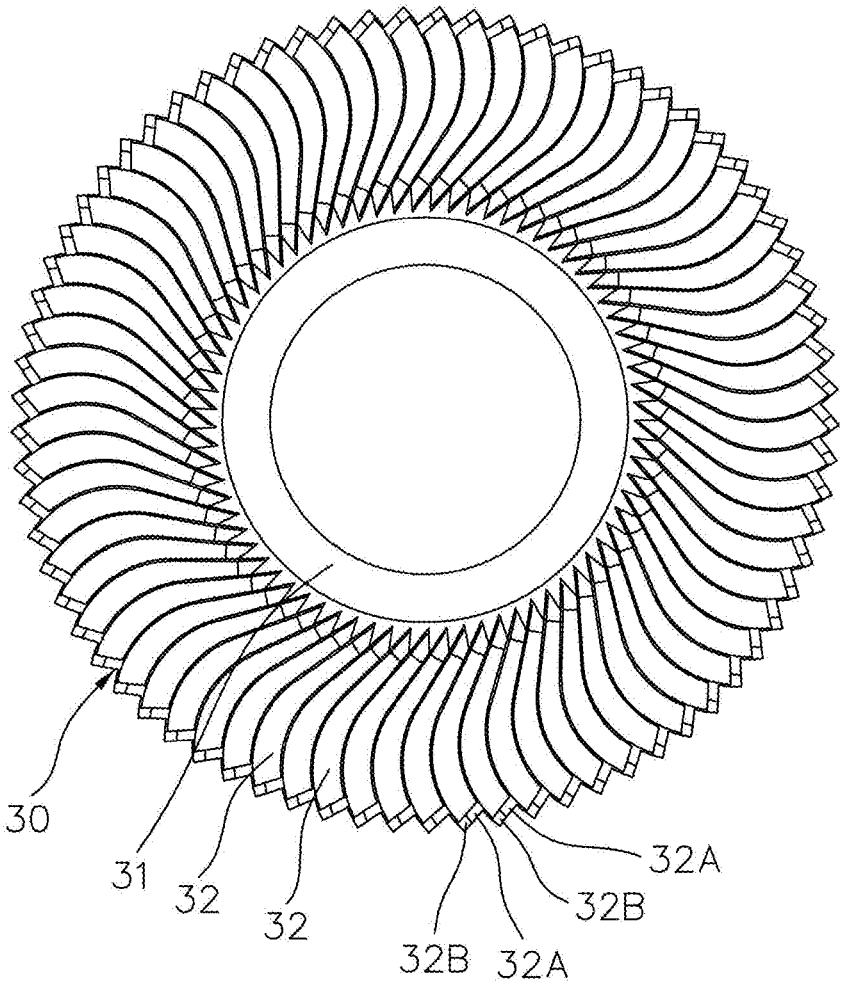
FIG. 4 is a front view of the components in FIG. 3.
Figure 5:
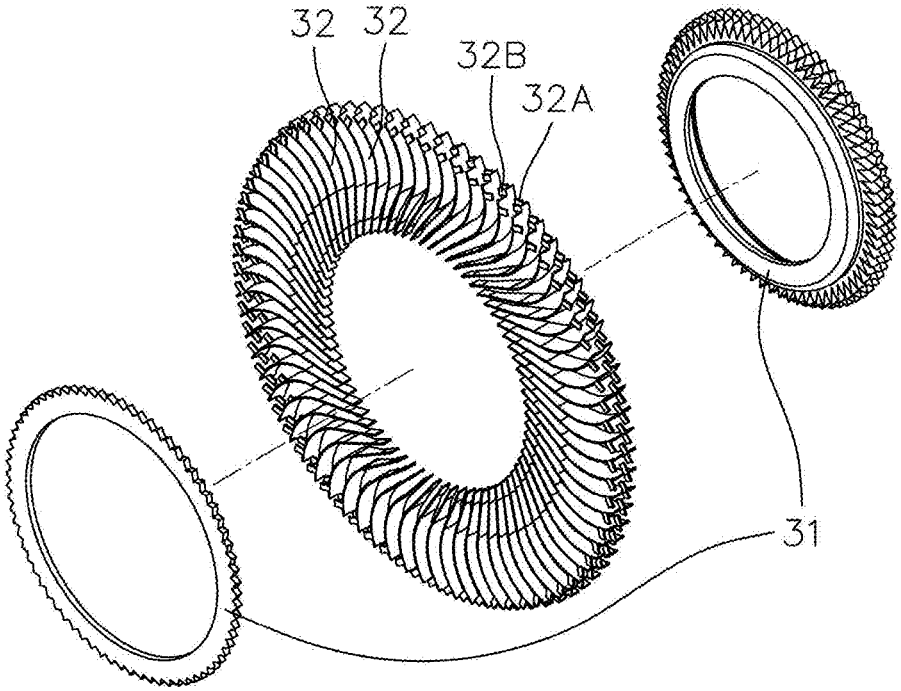
FIG. 5 is an exploded view of the components in FIG. 3.
Figure 6:
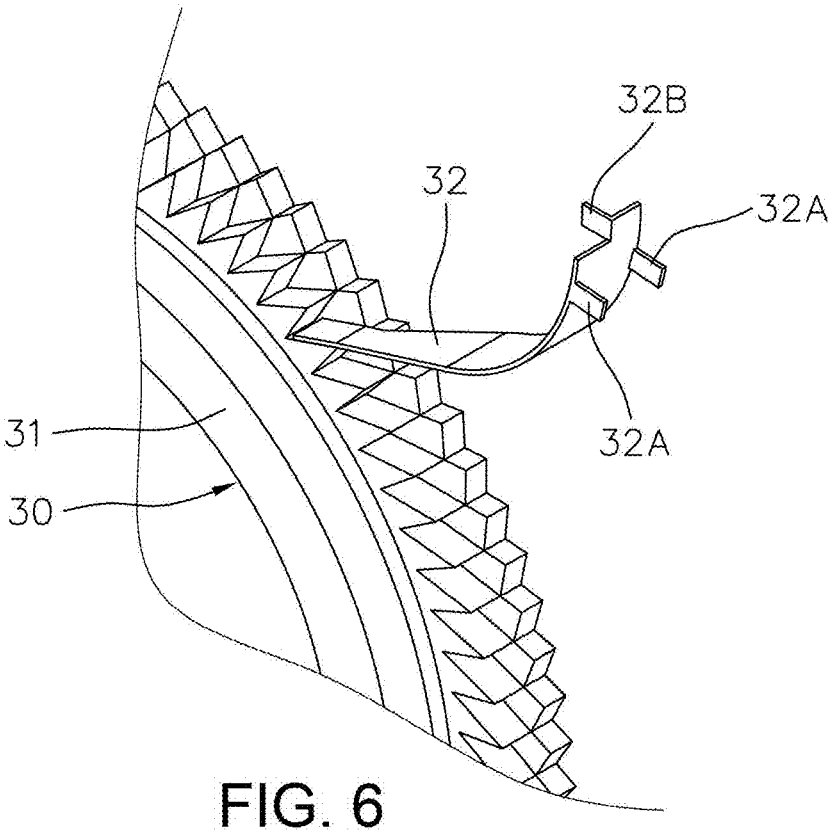
FIG. 6 is a fragmented view of some components in FIG. 3.
Figure 7:
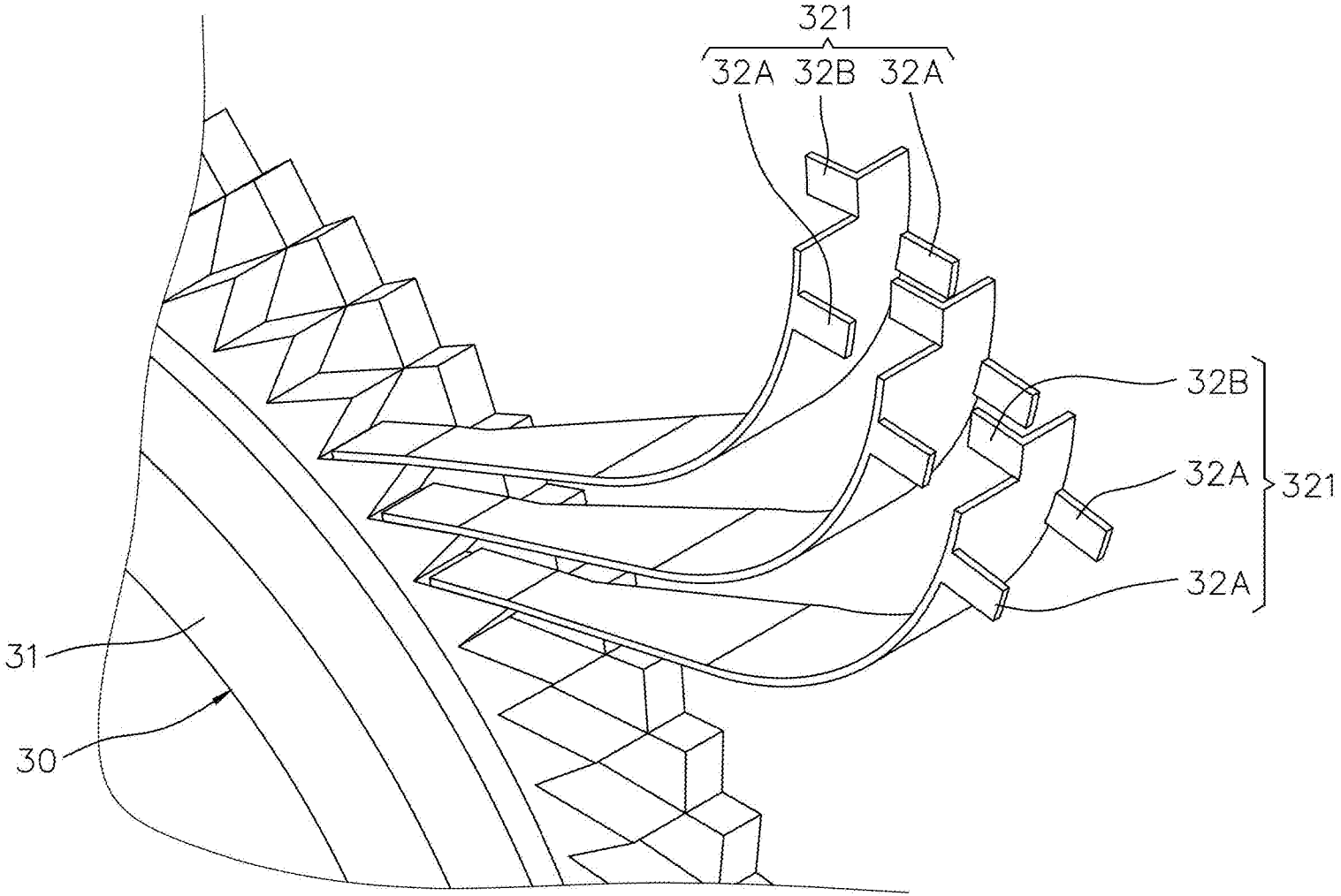
FIG. 7 is another fragmented view of some components in FIG. 3.

Referring to FIGS. 1 to 8, a centrifugal fan in centrifugal fan in accordance with a first preferred embodiment of the invention comprises the following components as discussed in detail below.

A housing 10 includes an upper housing 11 and a lower housing 12. The upper housing 11 has an air inlet 111 and an air outlet 112. An internal space 10A is defined by the upper housing 11 and the lower housing 12. The internal space 10A communicates with the air inlet 111 and the air outlet 112.

A driving part 20 is secured to the lower housing 12, disposed in the internal space 10A, and coaxial with the air inlet 111.

Figure 10A:
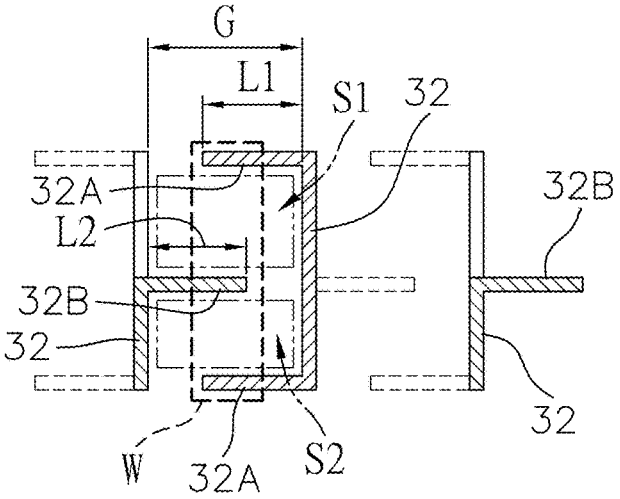
FIG. 10A is a longitudinal sectional view of some components according to the first preferred embodiment.
Figure 10B:
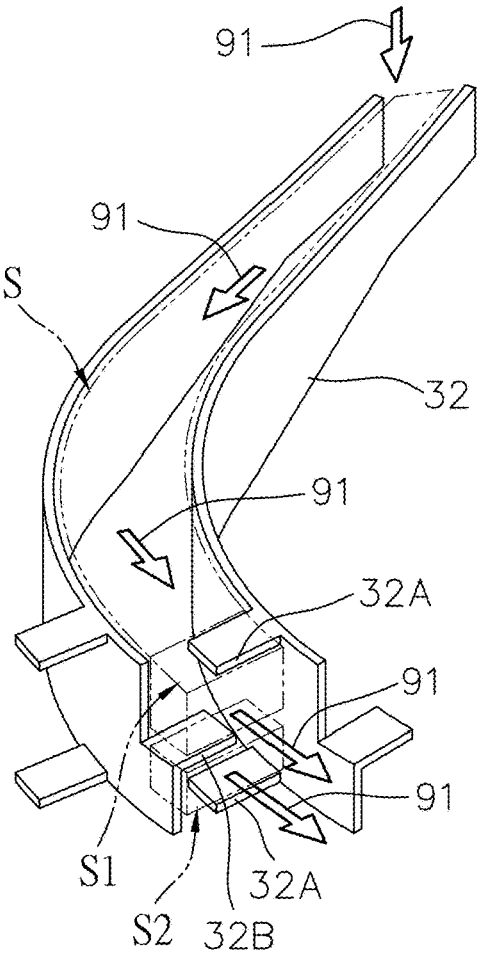
FIG. 10B is a perspective view of the flow channel space and the flow guide zone in FIG. 10A.
Figure 11A:
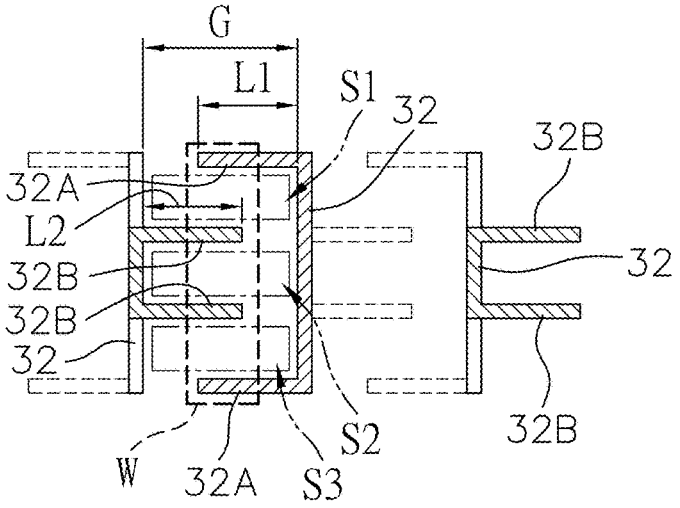
FIG. 11A is a longitudinal sectional view of some components according to the second preferred embodiment.
Figure 11B:
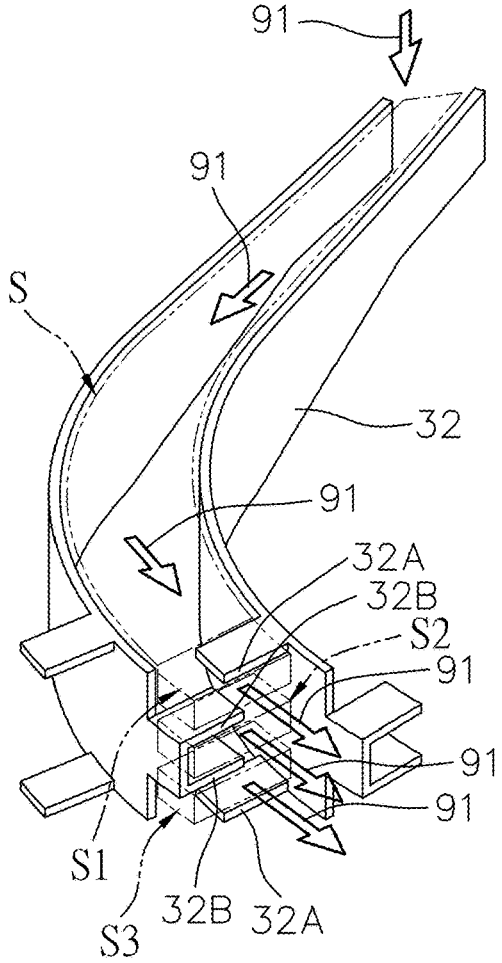
FIG. 11B is a perspective view of the flow channel space and the flow guide zone in FIG. 11A.
Figure 12:
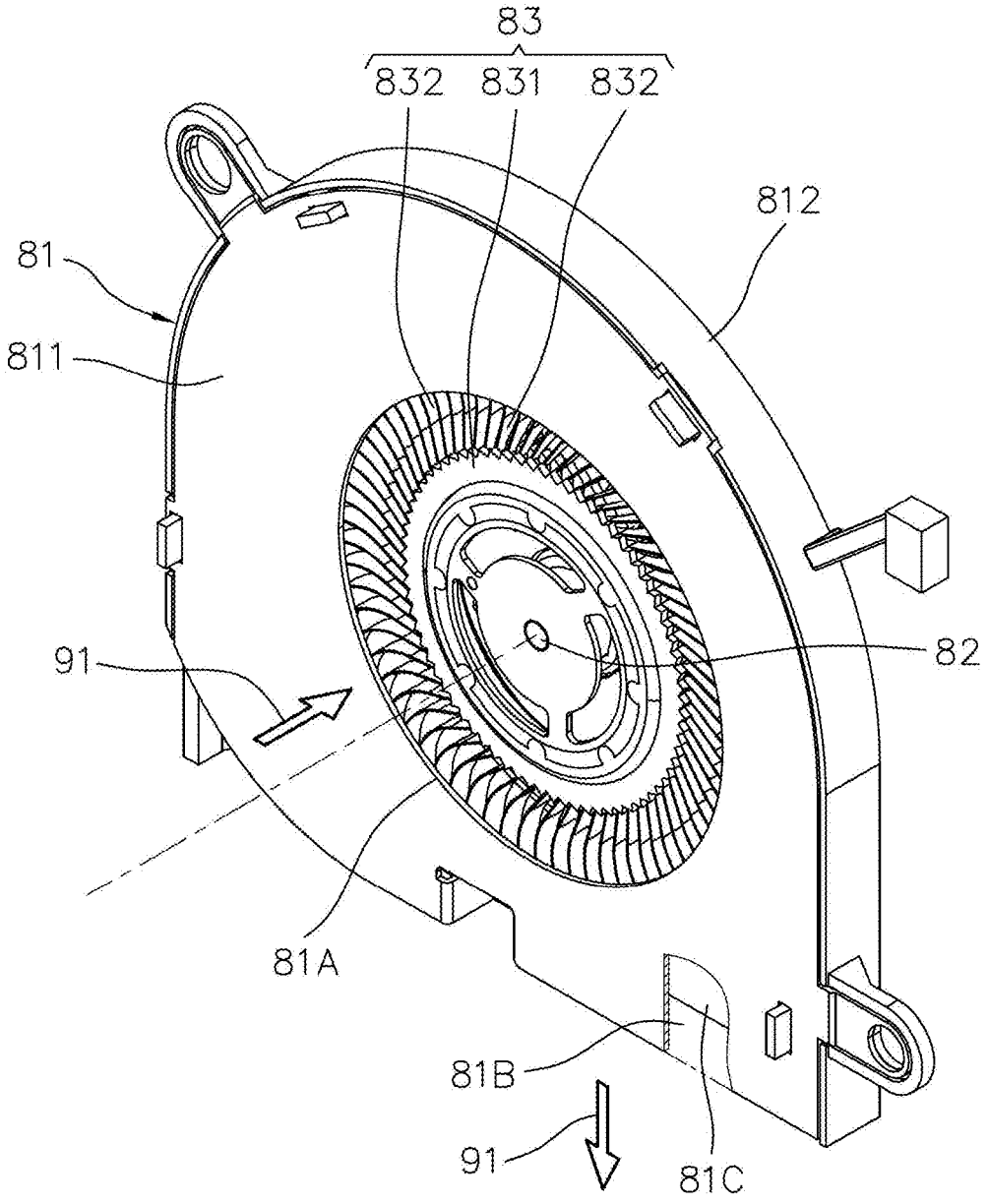
FIG. 12 (PRIOR ART)
FIG. 12 is a perspective view of the conventional centrifugal fan.
Figure 13:
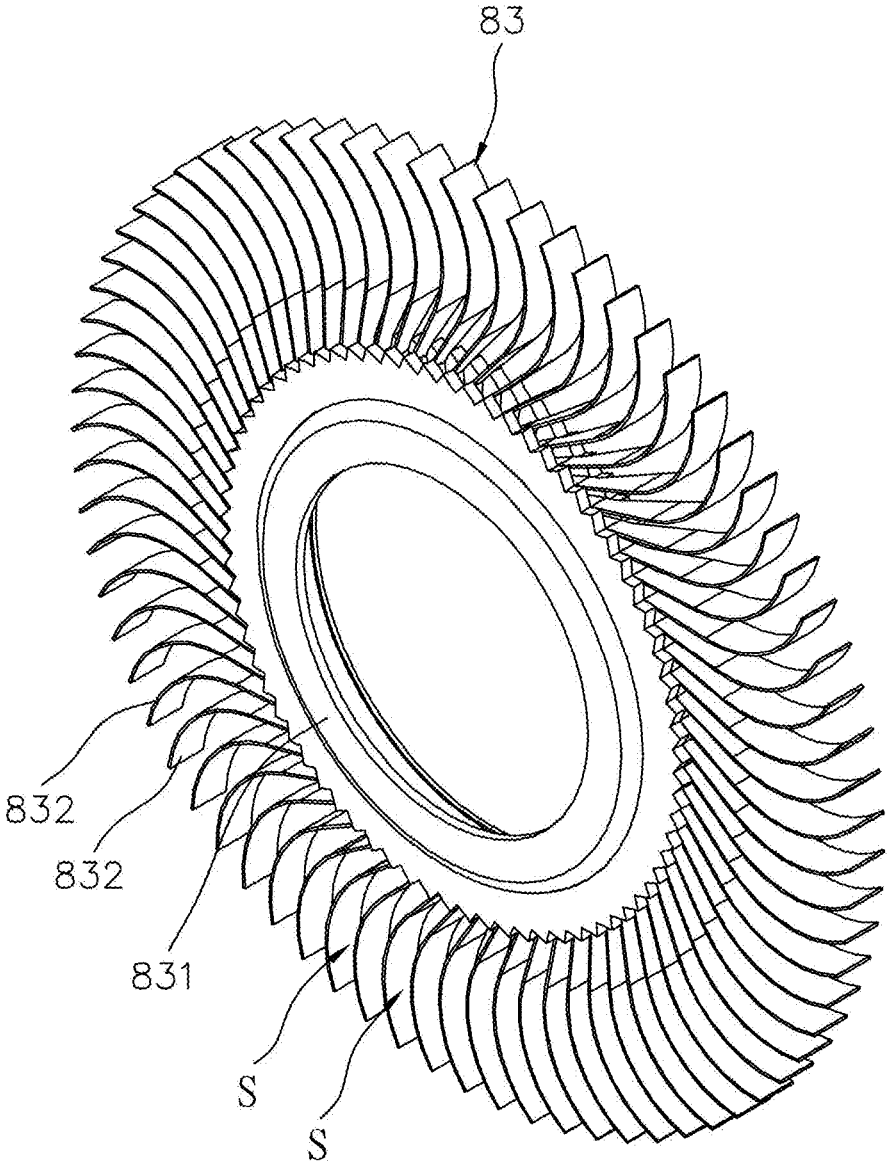
FIG. 13 (PRIOR ART)
FIG. 13 is an enlarged view of some components in FIG. 12.

An impeller 30 is disposed in the internal space 10A and coaxially connected to the driving part 20. The impeller 30 includes a ring-shaped member 31 and a plurality of blades 32. The ring-shaped member 31 is used to coaxially connect the impeller 30 to the driving part 20 and can be driven to rotate. The plurality of blades 32 extend radially outward from the ring-shaped member 31. Each blade 32 of the plurality of blades 32 include a flow guide 321. A flow channel space S is defined between every two adjacent blades 32 of the plurality of blades 32. The every two adjacent blades define a first adjacent blade and a second adjacent blade;

Each of the above flow guides 321 have two side flow guide vanes 32A and at least one dividing flow guide vane 32B. The adjacent two side flow guide vanes 32A and the at least one dividing flow guide vane 32B are used to divide the corresponding flow channel space S into at least two flow guide zones (e.g., a first flow guide zone S1 and a second flow guide zone S2 are shown in FIGS. 10A and 10B, or a first flow guide zone S1, a second flow guide zone, and a third flow guide zone S3 as shown in FIGS. 11A and 11B), thereby improving a flow guide effect. The at least one dividing flow guide vane 32B of the second adjacent blade 32 (the middle one in FIG. 10A) and the two side flow guide vanes 32A of the first adjacent blade 32 (the left one in FIG. 10A) are separated and not connected to each other.

Figure 8:
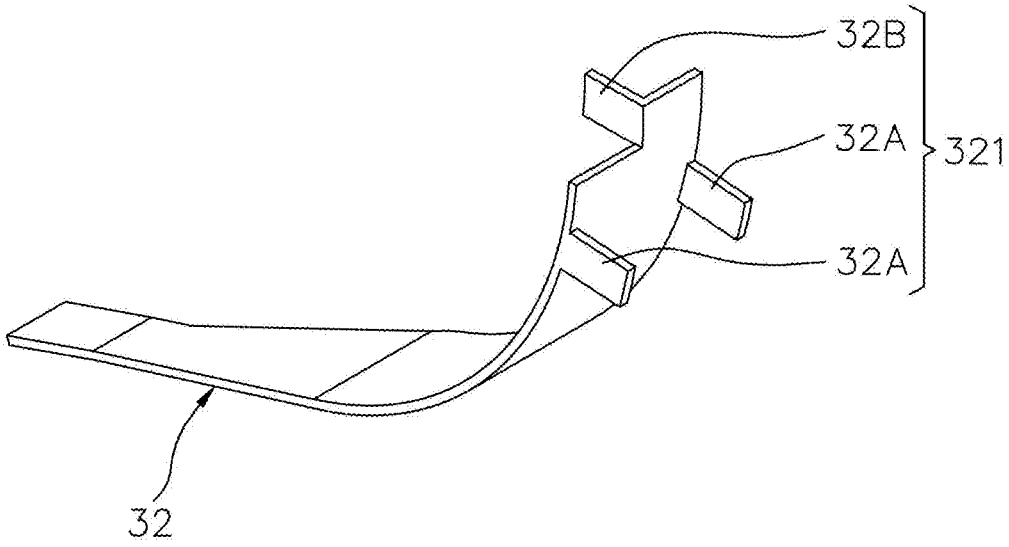
FIG. 8 is a perspective view of some components in FIG. 3.

In practice, each flow guide 321 can be disposed at an end of each blade 32 or adjacent to the end thereof (as shown in FIG. 8).

When the impeller 30 rotates, air 91 is sucked into the internal space 10A through the air inlet 111. The air 91 passes the plurality of blades 32 by a centrifugal force and flows through the at least two flow guide zones (e.g., the first flow guide zone S1 and the second flow guide zone S2 as shown in FIGS. 10A and 10B). Finally, the air 91 flows out of the air outlet 112. As a result, an effect of guiding flow is created.

Regarding the first embodiment of the invention (as shown in FIGS. 10A and 10B), the two side flow guide vanes 32A extend a first length L1 along a first direction (such as to the left) from the first adjacent blade 32 (the middle one in FIG. 10A). The two side flow guide vanes 32A are substantially perpendicular to the first adjacent blade 32. The at least one dividing flow guide vane 32B extends a second length L2 along a second direction (such as to the right) from the second adjacent blade 32 (the left one in FIG. 10A). The second direction is opposite to the first direction. A gap G is defined between the first adjacent blade 32 and the second adjacent blades 32. The first length L1 is larger than one half (such as approximately ⅔) of the gap G and the second length L2 is larger than one half (such as approximately ⅔) of the gap G so as to form an overlapping zone W. Hence, the at least one dividing flow guide vane 32B is sandwiched between the two side flow guide vanes 32A without contact. It forms a non-contact overlapping relationship.

The two side flow guide vanes 32A and the at least one dividing flow guide vane 32B are parallel to each other, thereby dividing the corresponding flow channel space S into the at least two flow guide zones, thereby improving the flow guide effect.

The at least two flow guide zones include a first flow guide zone S1 and a second flow guide zone S2. Therefore, the two side flow guide vanes 32A, the at least one dividing flow guide vane 32B, and the plurality of blades 32 have a same thickness, so that the two side flow guide vanes 32A are bendable from the first adjacent blade 32 and the at least one dividing flow guide vane 32B is bendable from the second adjacent blade 32. Thus, the two side flow guide vanes 32A and the at least one dividing flow guide vane 32B can be quickly bended from a thin plate by a traditional punching device or a pressing machine (such as first punching process for forming the two side flow guide vanes 32A and then a second punching process for forming the at least one dividing flow guide vane 32B).

Figure 9:
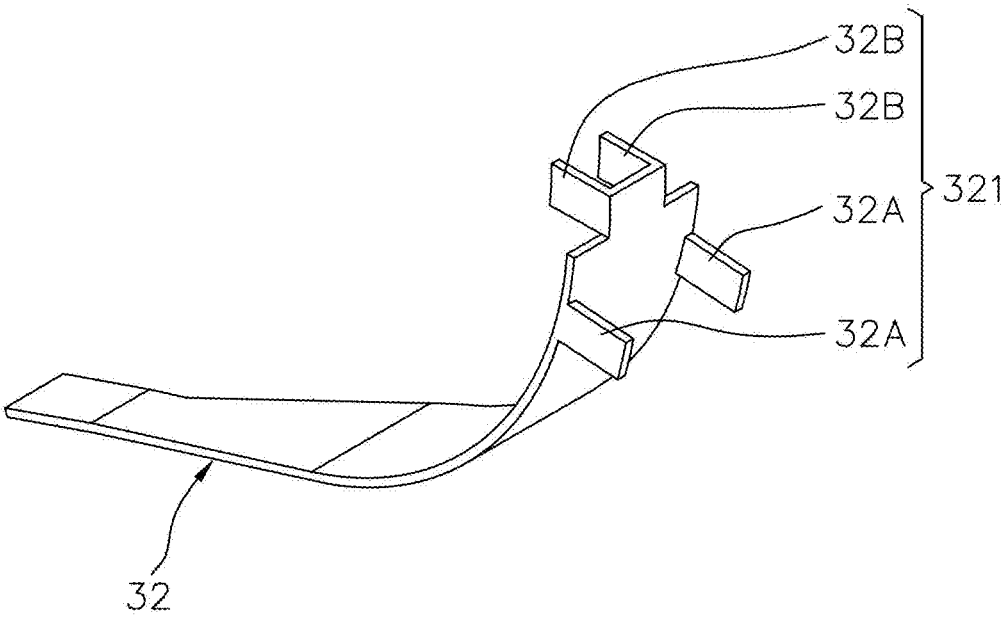
FIG. 9 is a perspective view of some components in FIG. 3 according to a second preferred embodiment of the invention.

Referring to FIG. 9, a second preferred embodiment of the invention is shown. The only difference between the first embodiment and the second embodiment is that the number of the at least one dividing guide vane 32B is two (as shown in FIGS. 11A and 11B). The first length L1 is larger than one half of the gap G and the second length L2 is larger than one half of the gap G so as to form an overlapping zone W. Hence, the at least two dividing flow guide vanes 32B are sandwiched between the two side flow guide vanes 32A without contact. It forms a non-contact overlapping relationship. Similarly, the corresponding flow channel space S is divided into at least three flow guide zones. This also improves the flow guide effect. Specifically, the at least three flow guide zones include the first flow guide zone S1, the second flow guide zone S2, and a third flow guide zone S3. Therefore, the two side flow guide vanes 32A, the two dividing flow guide vane 32B, and the plurality of blades 32 have a same thickness, so that the two side flow guide vanes 32A are bendable from the blades first adjacent blade 32 and the two dividing flow guide vane 32B is bendable from the second adjacent blade blades 32. Thus, the two side flow guide vanes 32A and/or the at least one dividing flow guide vane 32B can be quickly bended from a thin metal plate by a traditional punching device or a pressing machine.

What needs special attention is that the conventional centrifugal fan generates considerable noise during normal operation, especially when the conventional centrifugal fan is installed in a personal computer. The noise is very great. For reducing noise, the speed must be reduced (and the flow rate will also be reduced). For solving the above problem, each blade 32 of the plurality of blades 32 of the invention are provided with a flow guide 321. In this way, when the centrifugal fan of the invention is started, generated noise, pressure difference, flow rate and rotational speed are recorded and the same of the conventional centrifugal fan is also recorded as tabulated in Table 1 below.

TABLE 1

| Item | Conventional centrifugal fan | The invention |
|---|---|---|
| Rotational speed (RPM) | 6100 | 6660 |
| Flow rate (CFM) | 2.63 | 2.72 |
| Pressure difference (Pa) | 97.4 | 111.3 |
| Noise (dB) | 48.9 | 48.9 |

It can be clearly seen from the Table 1 above, for the invention the flow rate (CFM) is 2.72 and for the conventional centrifugal fan the flow rate (CFM) is 2.63 when they operate at the same noise level (e.g., 48.9 dB). That is, the flow rate is increased about 3.4%.

Similarly, for the invention the pressure difference (Pa) is 111.3 and for the conventional centrifugal fan the pressure difference (Pa) is 97.4 when they operate at the same noise level (e.g., 48.9 dB). That is, the pressure difference is increased about 19.3%. This also proves that the invention has a higher quality in comparison the conventional centrifugal fan.

The invention has the following advantages and benefits in comparison with the conventional art:

Improved fan efficiency at the same noise level. Regarding the invention, each blade of the plurality of blades is provided with a flow guide. When the centrifugal fan of the invention is started and generates a noise level of 48.9 (dB), and the conventional centrifugal fan is also started and generates the same noise level of 48.9 (dB), the flow rate of the centrifugal fan of the invention is increased by about 3.4% in comparison with the conventional centrifugal fan, and the pressure difference of the centrifugal fan of the invention is increased by about 19.3% in comparison with the conventional centrifugal fan. Therefore, the efficiency of the centrifugal fan of the invention is improved in terms of noise level.

Easy to manufacture. Regarding the invention, the guide part is only provided at the end of each blade. This is a technology that can be carried out simultaneously during the blade stamping process by a traditional punching device or a pressing machine. It can be implemented without any difficulty for those skilled in the art. Therefore, it is easy to manufacture.

While the invention has been described in terms of preferred embodiments, those skilled in the art will recognize that the invention can be practiced with modifications within the spirit and scope of the appended claims.

What is claimed is:

1. A centrifugal fan, comprising:

a housing including a lower housing, an upper housing having an air inlet and an air outlet, and an internal space defined by the upper housing and the lower housing, the internal space communicating with the air inlet and the air outlet;

a driving part secured to the lower housing, disposed in the internal space, and being coaxial with the air inlet; and an impeller disposed in the internal space and coaxially connected to the driving part, the impeller including a ring-shaped member for coaxially connecting the impeller to the driving part, the ring-shaped member being configured to drive for rotation, and a plurality of blades extending radially outward from the ring-shaped member wherein each blade of the plurality of blades include a flow guide, a flow channel space is defined between every two adjacent blades of the plurality of blades, the every two adjacent blades define a first adjacent blade and a second adjacent blade; each flow guide has two side flow guide vanes and at least one dividing flow guide vane, and the adjacent two side flow guide vanes and the at least one dividing flow guide vane are configured to divide the corresponding flow channel space into at least two flow guide zones; and wherein the at least one dividing flow guide vane of the second adjacent blade and the two side flow guide vanes of the first adjacent blade are separated and not connected to each other;

wherein the two side flow guide vanes extend a first length along a first direction from the first adjacent blade; the two side flow guide vanes are substantially perpendicular to the first adjacent blade;

the at least one dividing flow guide vane extends a second length along a second direction from the second adjacent blade, the second direction being opposite to the first direction;

a gap is defined between the first adjacent blade and the second adjacent blade; the first length is larger than one half of the gap and the second length is larger than one half of the gap so as to form an overlapping zone; the at least one dividing flow guide vane is sandwiched between the two side flow guide vanes without contact in the overlapping zone; the two side flow guide vanes and the at least one dividing flow guide vane are parallel to each other, thereby dividing the corresponding flow channel space into the at least two flow guide zones;

wherein said two side flow guide vanes, said at least one dividing flow guide vane, and said plurality of blades have a same thickness, so that said two side flow guide vanes are bendable from said first adjacent blade and said at least one dividing flow guide vane are bendable from said second adjacent blade.

2. The centrifugal fan of claim 1, wherein when the impeller rotates, air is sucked into the internal space through the air inlet, the air passes the plurality of blades by a centrifugal force, flows through the at least two flow guide zones, and flows out of the air outlet.

3. A centrifugal fan, comprising:

a housing including a lower housing, an upper housing having an air inlet and an air outlet, and an internal space defined by the upper housing and the lower housing, the internal space communicating with the air inlet and the air outlet;

a driving part secured to the lower housing, disposed in the internal space, and being coaxial with the air inlet; and an impeller disposed in the internal space and coaxially connected to the driving part, the impeller including a ring-shaped member for coaxially connecting the impeller to the driving part, the ring-shaped member being configured to drive for rotation, and a plurality of blades extending radially outward from the ring-shaped member wherein each blade of the plurality of blades include a flow guide, a flow channel space is defined between every two adjacent blades of the plurality of blades, the every two adjacent blades define a first adjacent blade and a second adjacent blade; each flow guide has two side flow guide vanes and at least one dividing flow guide vane, and the adjacent two side flow guide vanes and the at least one dividing flow guide vane are configured to divide the corresponding flow channel space into at least two flow guide zones; and wherein the at least one dividing flow guide vane of the second adjacent blade and the two side flow guide vanes of the first adjacent blade are separated and not connected to each other;

wherein the two side flow guide vanes extend a first length along a first direction from the first adjacent blade; the two side flow guide vanes are substantially perpendicular to the first adjacent blade;

the number of the at least one dividing flow guide vane is two; the two dividing flow guide vanes extend a second length along a second direction from the second adjacent blade, the second direction being opposite to the first direction;

a gap is defined between the first adjacent blade and the second adjacent blade; the first length is larger than one half of the gap and the second length is larger than one half of the gap so as to form an overlapping zone; the two dividing flow guide vanes are sandwiched between the two side flow guide vanes without contact in the overlapping zone; the two side flow guide vanes and the two dividing flow guide vanes are parallel to each other, thereby dividing the corresponding flow channel space into the at least three flow guide zones; and the at least three flow guide zones include a first flow guide zone, a second flow guide zone, and a third flow guide zone;

wherein said two side flow guide vanes, said two dividing flow guide vanes, and said plurality of blades have a same thickness, so that said two side flow guide vanes are bendable from said first adjacent blade and said two dividing flow guide vanes are bendable from said second adjacent blade.

4. The centrifugal fan of claim 3, wherein when the impeller rotates, air is sucked into the internal space through the air inlet, the air passes the plurality of blades by a centrifugal force, flows through the at least three flow guide zones, and flows out of the air outlet.

* * * * *